US005259525A

United States Patent [19]

Wion

[11] Patent Number: 5,259,525

[45] Date of Patent: Nov. 9, 1993

[54] PAINT CONTAINER HOLDER

[75] Inventor: Guy E. Wion, Box 135, Lebanon, Kans. 66952

[73] Assignee: Guy Wion, Lebanon, Kans.

[21] Appl. No.: 492,083

[22] Filed: Apr. 26, 1990

[51] Int. Cl.[5] ..... E06C 7/14

[52] U.S. Cl. ..... 220/737; 248/210

[58] Field of Search ..... 220/85 H; 248/210, 231.3, 248/231.9; 182/120

[56] References Cited

U.S. PATENT DOCUMENTS

| | | | |
|---|---|---|---|
| 3,737,188 | 6/1973 | Myers | 220/90 X |
| 3,948,413 | 4/1976 | Gorrell et al. | 220/90 |
| 3,985,203 | 10/1976 | Erlenbach | 248/210 X |
| 4,099,693 | 7/1978 | Blann | 248/210 |
| 4,186,903 | 2/1980 | Fazakerley | 248/210 |
| 4,445,659 | 5/1984 | LaChance | 248/210 |
| 4,523,733 | 6/1985 | Lunden, Jr. | 248/210 |

FOREIGN PATENT DOCUMENTS

| | | | |
|---|---|---|---|
| 683720 | 12/1952 | United Kingdom | 248/210 |

*Primary Examiner*—Steven M. Pollard
*Attorney, Agent, or Firm*—Guy Wion

[57] ABSTRACT

A paint container holder for use with a ladder having hollow rungs, the interiors of which are accessible from the side of the ladder. The paint container holder having a support portion including a planar support surface and a support arm extending from an edge of the support portion and sized to fit within the hollow rung. A wedge shaped member is provided to be inserted into the hollow rung, between the support arm and the interior surface of the rung, to secure the holder to the ladder.

2 Claims, 3 Drawing Sheets

PAINT CONTAINER HOLDER

BRIEF SUMMARY OF THE INVENTION

This invention relates to a paint container holder to be employed with ladders having hollow rungs.

It is an object of the present invention to provide a paint container holder, which is attachable to a ladder having hollow rungs, to provide a stable platform which can accommodate a paint container, i.e. paint can or roller pan.

The object will be readily apparent upon the study of the following specification and accompanying drawings.

DETAILED DESCRIPTION OF THE INVENTION

Figure 1:
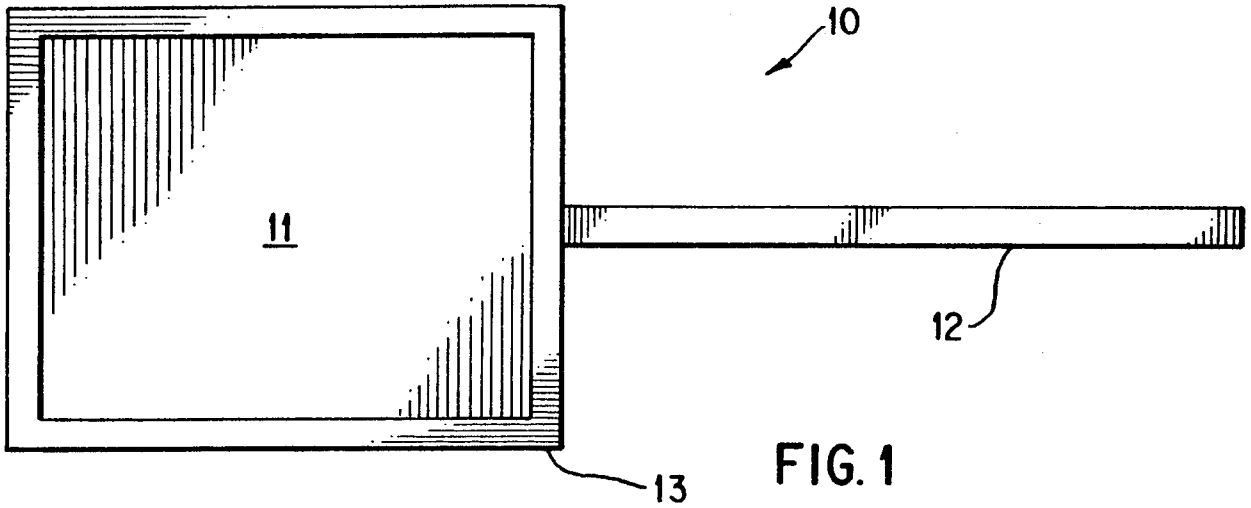
FIG. 1 is a top view of the support portion of the paint container holder.

Referring now to FIG. 1, there is shown a top view of the paint container holder 10 for use with a ladder 16 having hollow rungs 16, the interiors of which are accessible from the side of the ladder 15. As shown in FIG. 1, the paint container holder 10 includes a planar support surface 11, upon which a paint container, i.e. paint can or roller pan, is to be placed. A support arm 12 extends from an edge of the planar support surface 11 and is sized to fit within the hollow rung 16 of the ladder 15.

The planar support surface 11 may have upwardly extending sides 13 extending around the periphery of the planar support surface 11.

Figure 2:
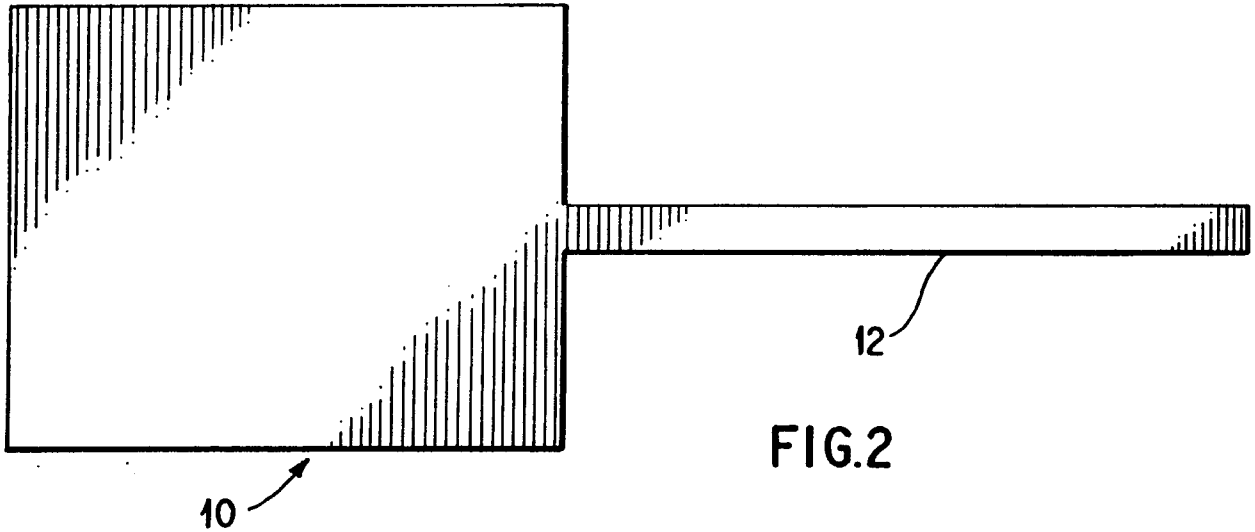
FIG. 2 is a bottom view of the support portion of the paint container holder.
Figure 3:
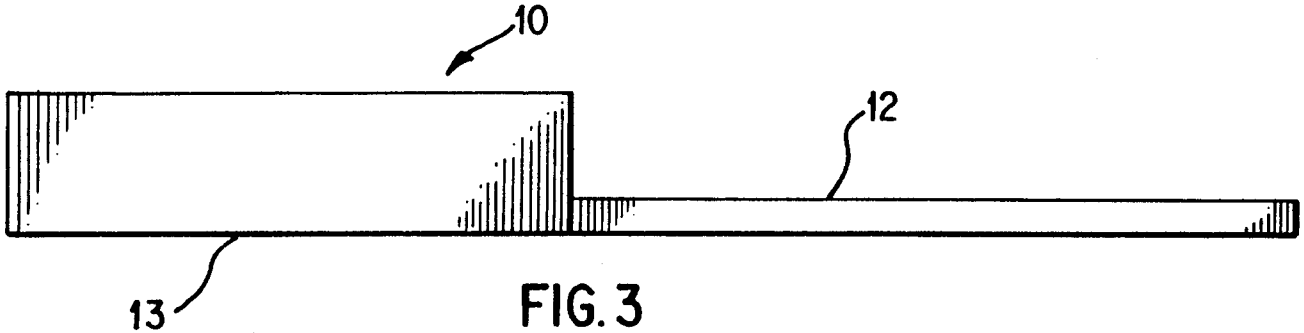
FIG. 3 is a side view of the support portion of the paint container holder.

FIG. 2 discloses a bottom view of the paint container holder and FIG. 3 is a side view of the paint container holder.

Figure 4:
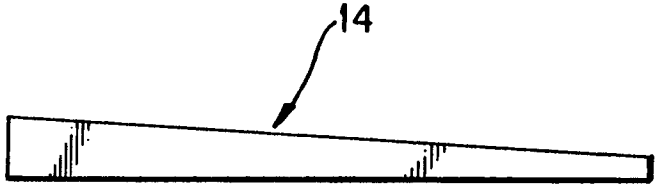
FIG. 4 is a side view of the wedge.
Figure 5:
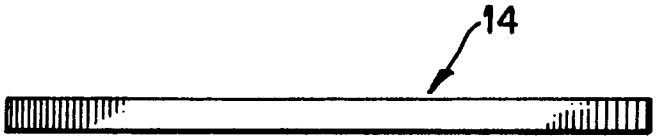
FIG. 5 is a top view of the wedge.
Figure 6:
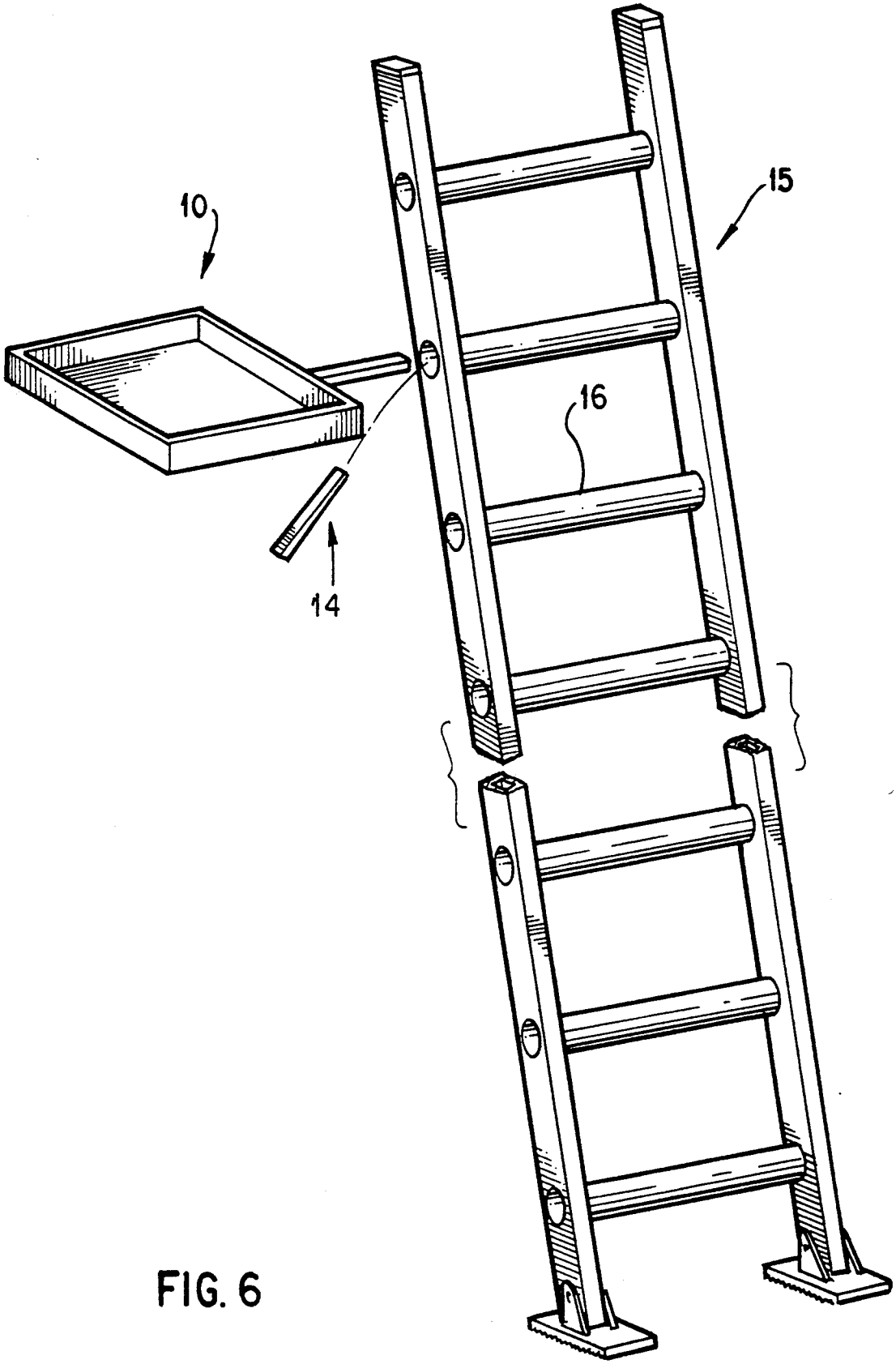
FIG. 6 illustrates the relationship of the paint container holder to the ladder to which it is to be mounted.

A wedge member 14, as shown in FIG. 4 and 5, is provided to be slid between the support arm 12 of the paint container holder 10 and an inside surface of the hollow rung 16 of the ladder 15, to retain the paint container holder 10 in position on the ladder 15. The wedge member 14 and the support arm 12 are sized such that upon insertion of the support arm 12 within the hollow ladder rung 16, the wedge member 14 may then be inserted to stabilize the paint container holder 10 on the ladder 15. This relationship is shown in FIG. 6.

While there has been described what is considered a preferred embodiment of the invention, it will be obvious to those skilled in the art that various changes and modifications may be made without departing from the invention as called for in the appended claims.

What is claimed is:

1. A paint container holder for use with a ladder having hollow rungs which are open, the interiors of which are accessible from the side of the ladder, the paint container holder having a support portion including a planar support surface and a support arm extending from an edge of said support portion, and sized to fit within the hollow rung, and a wedge shaped member, sized to fit between said support arm and the interior surface of said hollow rung when said extension is inserted within said rung, said extension and said wedge shaped member to be inserted into said hollow rung to secure said holder to said ladder.

2. The paint container holder, as set forth in claim 1, wherein said support portion includes a central planar support surface and upwardly extending sides around the periphery thereof.

* * * * *